US008572937B2

(12) United States Patent
Gustafsson

(10) Patent No.: US 8,572,937 B2
(45) Date of Patent: Nov. 5, 2013

(54) DEVICE AND METHOD FOR FILLING OF A CONTAINER

(75) Inventor: Per Gustafsson, Bjärred (SE)

(73) Assignee: Ecolean AB, Helsingborg (SE)

( * ) Notice: Subject to any disclaimer, the term of this patent is extended or adjusted under 35 U.S.C. 154(b) by 125 days.

(21) Appl. No.: 12/680,008

(22) PCT Filed: Sep. 26, 2008

(86) PCT No.: PCT/SE2008/051086

§ 371 (c)(1),
(2), (4) Date: Mar. 25, 2010

(87) PCT Pub. No.: WO2009/041909

PCT Pub. Date: Apr. 2, 2009

(65) Prior Publication Data

US 2010/0206424 A1 Aug. 19, 2010

(30) Foreign Application Priority Data

Sep. 28, 2007 (SE) ..... 0702168

(51) Int. Cl.
*B65B 1/04* (2006.01)

(52) U.S. Cl.
USPC ..... 53/558; 53/452; 53/543

(58) Field of Classification Search
USPC ..... 53/443, 452, 455, 477, 543, 558, 562
See application file for complete search history.

(56) References Cited

U.S. PATENT DOCUMENTS 4,115,978 A * 9/1978 Langemeyer et al. ..... 53/570
5,337,539 A * 8/1994 Barton ..... 53/413
5,943,847 A * 8/1999 Chalendar ..... 53/543
6,401,439 B1 6/2002 Tetenborg et al.
6,460,317 B1 * 10/2002 Voss ..... 53/570
7,430,844 B2 * 10/2008 Buchman et al. ..... 53/562
7,444,795 B2 * 11/2008 Yasuhira ..... 53/403
7,600,360 B2 * 10/2009 Schroeder et al. ..... 53/452
7,770,362 B2 * 8/2010 Koehn ..... 53/459

(Continued)

FOREIGN PATENT DOCUMENTS

DE 10217397 A1 3/2010
EP 1172295 A1 * 1/2002

(Continued)

*Primary Examiner* — Alexandra Elve
*Assistant Examiner* — Eyamindae Jallow
(74) *Attorney, Agent, or Firm* — Volpe And Koenig, P.C.

(57) ABSTRACT

A device for handling containers of a collapsible type, including one or more stations and a transport unit. The device is arranged to receive the containers oriented in a first direction and the transport unit is arranged to transport the containers to at least one of the stations by moving the containers in a second direction along a curved path, the second direction being perpendicular to the first direction. The device has a holding device provided for at least one station and located in a stationary position adjacent to the station and a transfer device, which is provided for the at least one station and carried by the transport unit and which is cyclically movable along an endless path between a pick-up position and a delivery position located adjacent to the station. The transfer device is arranged to pick up at least one container in the pick-up position and transfer the at least one container, in the delivery position, to the holding device. The disclosure also concerns a method for handling containers of a collapsible type in a filling machine.

19 Claims, 7 Drawing Sheets

(56) References Cited

U.S. PATENT DOCUMENTS

| | | | | |
|---|---|---|---|---|
| 2003/0196411 | A1* | 10/2003 | Schroeder et al. | 53/410 |
| 2004/0206055 | A1* | 10/2004 | Schroeder et al. | 53/512 |
| 2005/0086911 | A1* | 4/2005 | Dutt et al. | 53/412 |
| 2006/0070351 | A1* | 4/2006 | Hudetz et al. | 53/410 |
| 2006/0096254 | A1* | 5/2006 | Rogers | 53/469 |
| 2006/0185325 | A1* | 8/2006 | Buchman et al. | 53/412 |
| 2007/0089377 | A1 | 4/2007 | Yasuhira | |
| 2007/0277480 | A1* | 12/2007 | Ford | 53/443 |
| 2007/0289262 | A1* | 12/2007 | Koehn | 53/570 |
| 2009/0056281 | A1* | 3/2009 | Murray | 53/455 |
| 2010/0139217 | A1* | 6/2010 | Fitzgerald, IV et al. | 53/455 |

FOREIGN PATENT DOCUMENTS

| | | |
|---|---|---|
| JP | 51-135785 | 11/1976 |
| JP | 06-122459 | 5/1994 |
| JP | 2001-18901 | 1/2001 |
| JP | 2007-118961 | 4/2007 |

* cited by examiner

DEVICE AND METHOD FOR FILLING OF A CONTAINER

TECHNICAL FIELD

The present invention relates to a device and a method for handling containers, and more specifically for handling containers of a collapsible type.

BACKGROUND ART

It has become increasingly common to package liquid products, in particular liquid food products such as water, milk, juice or wine, in containers of a collapsible type.

By a container of a collapsible type is meant a container having a compartment which is defined by flexible walls and whose volume is dependent on the relative position of the walls.

It is known to manufacture webs consisting of interconnected containers of the type described above rolled onto a bobbin and to arrange such a roll in a filling machine.

A filling machine of this kind is known, for example, from WO99/41149. The document discloses how the rolled-out web of container blanks is fed through the filling machine so as to arrive, in order of priority, at a station for cutting open a filling duct, at a station for filling each container and at a sealing station for sealing the filled containers.

A filling machine usually represents a relatively considerable investment and there is, thus, a need for filling machines of a simple design as well as filling machines with a high filling capacity, i.e. which are capable of filling a comparatively large number of containers per time unit.

SUMMARY OF THE INVENTION

In view of the above, it is an object of the present invention to provide an improved device for handling containers of a collapsible type.

To achieve this object a device is provided according to the present invention having the features as defined in claim 1 and a method having the features as defined in claim 18. Embodiments of the device will be apparent from claims 2-17 and an embodiment of the method will be apparent from claim 19.

More specifically, according to the present invention a device is suggested for handling containers of a collapsible type, comprising one or more stations and a transport unit. The device is arranged to receive said containers oriented in a first direction and the transport unit is arranged to transport said containers to at least one of said stations by moving the containers in a second direction along a curved path, said second direction being perpendicular to said first direction. The device is characterised by a holding means provided for the at least one station and arranged in a stationary manner adjacent to the station and a transfer means which is provided for said at least one station and carried by the transport unit, said means being cyclically displaceable along an endless path between a pick-up position and a delivery position located adjacent to the station. The transfer means is arranged to pick up at least one container in the pick-up position and to transfer said at least one container, in the delivery position, to the holding means.

An improved device for handling containers of a collapsible type is thus obtained. The device may be used, for instance, in a filling machine. The containers are oriented in a first direction and are then moved to at least one station in a second direction perpendicular thereto along a curved path. Thus, each container may be moved laterally to said at least one station. Containers of a collapsible type are in a flat state before filling and, therefore, have a very small extent in the transverse direction. As a result, to transport a container from a feeding position to a station, or from one station to another, the required distance that the container must be moved is minimised. By conveying the container along a curved path, it is possible to ensure that the container upon arrival docks with the station concerned. In this way, the container is brought to the station, which means that the station can be of a comparatively simple design. The transfer means adapted to be cyclically movable along an endless belt performs in a reliable manner the transport of containers in the second direction along a curved path.

The containers for which the device is designed each comprise a compartment which is defined by two opposite side walls and a bottom wall, said side walls being joined at a top portion thereof for forming an upper side extending along a line, the orientation of the containers in said first direction resulting in the upper sides of the containers being arranged substantially parallel to said first direction.

According to one embodiment of the present invention the transport unit may be arranged to engage a top portion of said containers during transport thereof. This means that the containers are gripped in such a manner as to be suspended from the transport unit.

The holding means may be operable between a closed position for gripping a container and an open position for releasing a container, the holding means being arranged to assume the closed position and the open position, respectively, in response to the transfer means, when traveling along said endless path, passing the delivery position and the pick-up position, respectively. The transfer means may be operable between an open position for releasing a container and a closed position for gripping a container, said transfer means, during its travel along the endless path, being arranged to assume the closed position and the open position when passing the pick-up position and the delivery position, respectively. Coordination of the first and the second pinching means for picking up and transferring the containers is thus obtained.

The device may comprise a unit for pneumatically controlling the holder means and the transfer means.

The transfer means may be arranged, when passing the delivery position, to have a component of movement that is perpendicular to said second direction. This enables the containers to dock with the station concerned in a simple manner.

The endless path along which the transfer means (18) is movable may have the shape of a circle, the pick-up position being located in a position corresponding to nine o'clock and the delivery position being located in a position corresponding to three o'clock.

According to one embodiment, one of the at least one station may be a filling station having a filling tube, which through a relative motion is insertable in a filling duct in the containers. The filling tube of the filling station may be stationary.

According to another embodiment, one of the at least one station may be an opening station provided with opening means, which are arranged to separate side wall portions of the containers for the purpose of opening a filling duct.

According to yet another embodiment, one of the at least one station may be a sealing station provided with sealing means arranged to seal a filling duct in the containers.

According to a further embodiment, one of said at least one station may be a gas-filling station, which comprises a gas means for supplying a gas to a handle portion of the containers, the gas means being arranged to supply said gas through a hole formed in one of the side walls of the containers and communicating with the handle portion through a gas duct.

According to a still further embodiment, one of said at least one station may be a sealing station, which comprises a sealing means for sealing a gas duct for enclosing a gas supplied to a handle portion of the containers.

According to another embodiment of the present invention, the transport unit may be arranged to transport said containers to a plurality of stations by moving them in the second direction along curved paths, said stations being arranged one after the other as seen in said second direction.

Each station may be arranged for simultaneous handling of a plurality of containers. The transport unit is arranged to handle a corresponding number of containers.

According to yet another embodiment of the present invention, the transport unit may be carried by a rotatable mount at a distance from an axis of rotation of the mount.

The present invention further suggests a method for handling containers of a collapsible type in a filling machine, said containers having each a compartment defined by two opposite side walls and a bottom wall, comprising the steps of orienting the containers in a first direction so that an upper side of each container is arranged substantially parallel to said direction, and transporting the containers to at least one station by moving them in a second direction along a curved path, said second direction being perpendicular to said first direction. The method is characterised in that the step of transporting said containers is achieved by means of a transfer means which is provided for said at least one station and which is cyclically moved along an endless path between a pick-up position and a delivery position located adjacent to the station, the transfer means picking up at least one container in the pick-up position and delivering said at least one container in the delivery position.

A method that allows efficient handling of containers of a collapsible type is thus obtained. By moving the containers in the second direction, which is a transverse direction, the distance that a container has to be moved to transfer it from one station to another is minimised. By moving the container along a curved path, it is possible to ensure that each container upon arrival docks with the station concerned, which may be a filling station. Accordingly, the station does not have to be designed so as to be movable to the container.

BRIEF DESCRIPTION OF THE DRAWINGS

Embodiments of the present invention will now be described by way of example with reference to the accompanying drawings, in which.

DESCRIPTION OF EMBODIMENTS

Figure 1:
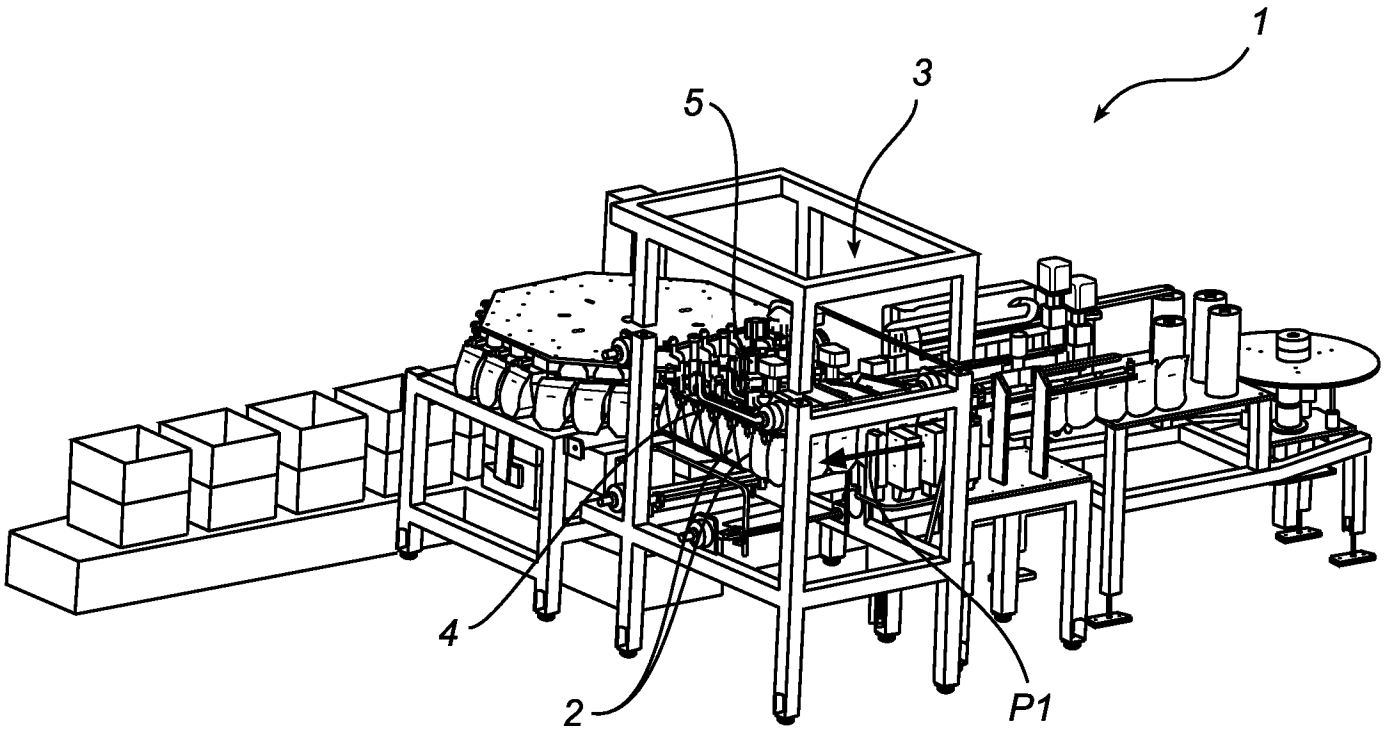
FIG. 1 is a perspective view of a filling machine comprising a device for handling containers according to the present invention.

With reference to FIG. 1, a filling machine 1 for filling containers 2 of a collapsible type is shown.

The containers 2 may be made from a laminated film material, which may comprise a body layer made from a mineral filler, such as chalk, and a polyolefine binder.

Each container 2 may have a compartment which is defined by two opposite side walls and a bottom wall and whose volume is dependent on the relative position of the flexible walls.

The containers 2 may be provided in an interconnected state and rolled onto a bobbin. In the filling machine 1, the containers 2 are rolled out and separated from each other.

The containers 2 may be provided in a flat and closed state. This ensures that containers 2 that have been sterilized in connection with manufacture can be distributed in this sterile condition to, for instance, a dairy plant.

The filling machine 1 shown in FIG. 1 comprises a device 3 according to the present invention for handling containers 2 of a collapsible type. It will be appreciated, however, that the inventive device 3 may be used in other contexts for handling containers 2 of a collapsible type.

In the embodiment shown, the device 3 comprises, as main components, a plurality of stations S and a transport unit 4. It will be appreciated that the device 3 could also comprise only one station S.

The illustrated embodiment of the inventive device 3 is arranged to receive the containers 2 when they are in a separated, flat and opened state. By open state is meant that an end seal of each originally sealed container 2 has been removed by cutting or shearing, so that the compartment of the container 2 communicates with the surroundings via a filling duct.

The device is further arranged to receive the containers 2 oriented in a first direction P1. In the embodiment shown, this orientation is equivalent to the upper sides of the containers 2, which sides extend along a line, being arranged substantially parallel to said first direction P1. With the containers in the flat condition described above, said first direction P1 will also coincide with the plane of extension of the side walls of the containers 2.

Figure 2:
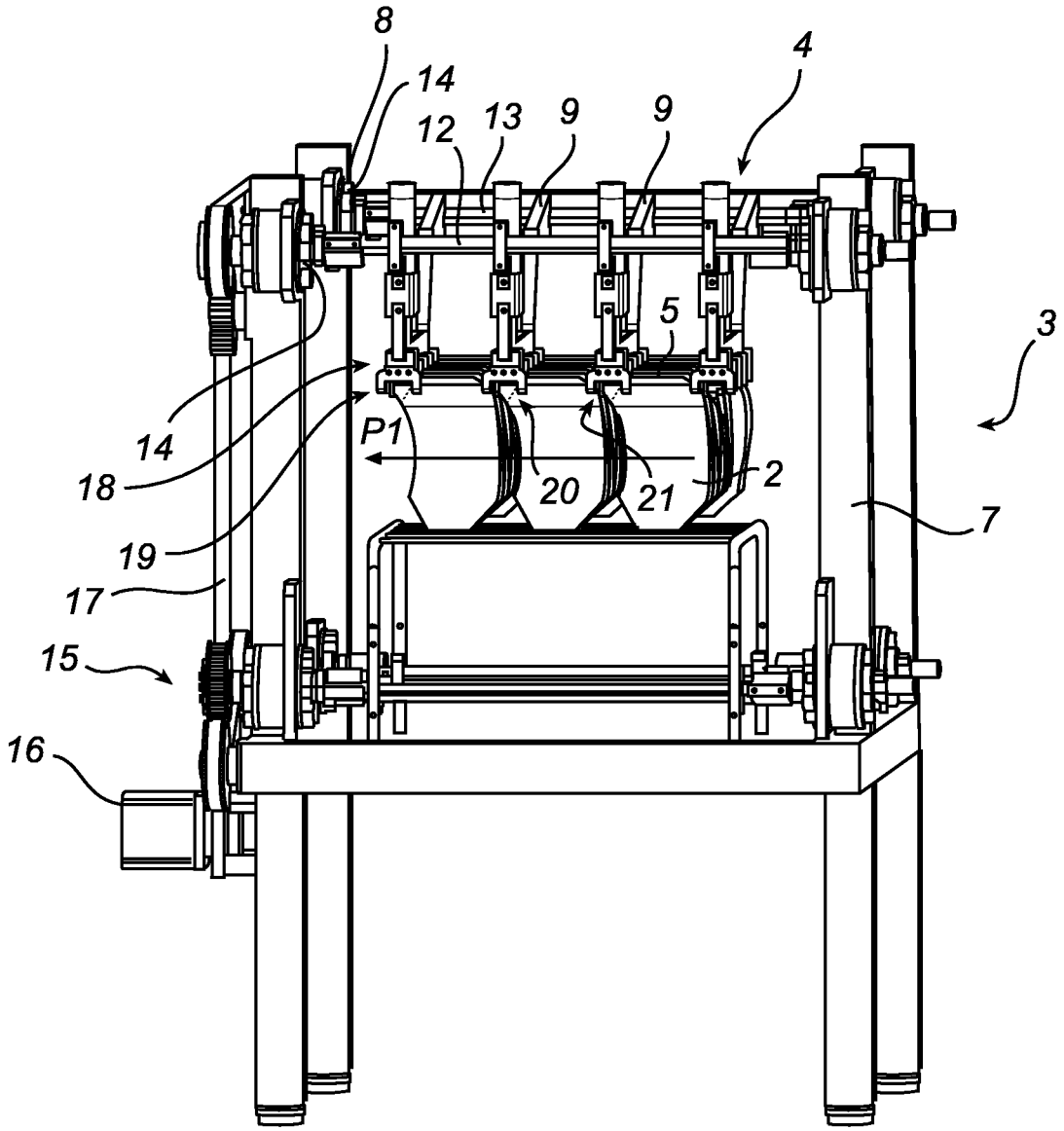
FIG. 2 is a perspective view of the device shown in FIG. 1.
Figure 3:
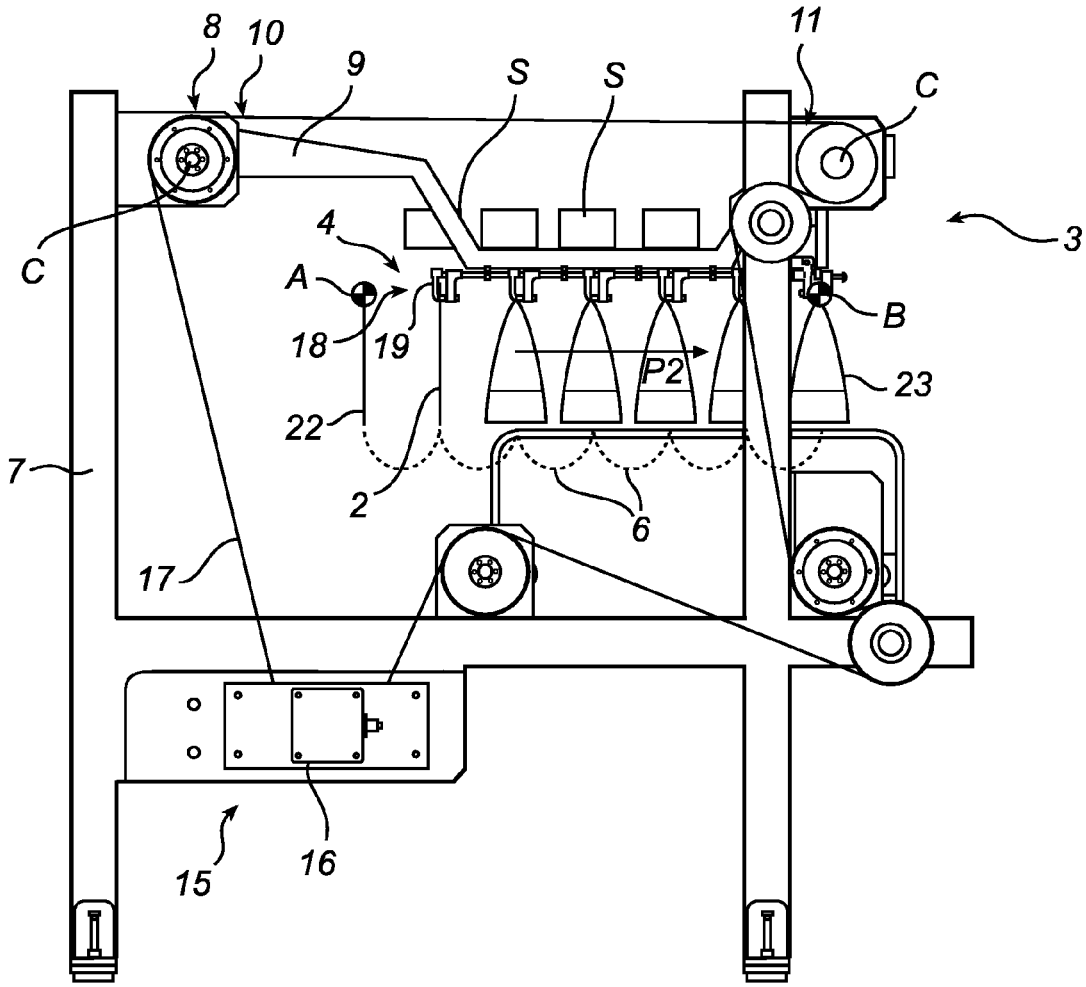
FIG. 3 is a side view of the device in FIG. 1.

In FIG. 2 and FIG. 3, to which reference is now made, the inventive device 3 illustrated in FIG. 1 is shown separately, certain parts having been left out for the sake of clarity. In FIG. 2 no stations are illustrated and in FIG. 3 the stations S are only schematically indicated.

The orientation of the containers 2 in said first direction P1 is evident from FIG. 2 and the upper sides 5 of the containers 2 are clearly visible.

The transport unit 4 of the device 3 is arranged to transport the containers 2 to the stations S by moving the containers 2 in a second direction P2 along a curved path 6, as indicated by dashed lines in FIG. 3. The second direction P2, referred to below as a transverse direction, is perpendicular to said first direction P1.

A frame 7 supports a plurality of mounts 8. The mounts 8 are rotatably carried in bearings on the frame 7 and carry the transport unit 4. More specifically, each mount 8 is arranged to carry the transport unit 4 at a radial distance from the centre of rotation of the mount 8.

In the embodiment shown, the transport unit 4 comprises four parallel beams 9. The beams 9 are rigidly connected, at a first end 10, to a first shaft 12 extending transversely of their longitudinal direction and, at a second end 11 opposite the first end 10, to a second shaft 13 extending transversely of their longitudinal direction.

Each mount 8 comprises an arm 14, which extends radially from the respective centre of rotation C and which at its end facing away from the centre of rotation C is pivotally connected to an associated shaft end.

In the perspective view of FIG. 2, the arms are indicated at 14, but will be more readily understood from the schematic embodiment described below with reference to FIGS. 4*a-i*.

The mounts 8 on one side of the frame 7 are rotatable by means of a drive assembly 15, which in the embodiment shown comprises an electric motor 16 and a driving belt 17.

Thus, by driving the electric motor 16 the mounts 8 located on one side of the frame 7 are being rotated, whereby the mounts 8 via arms 14 associated therewith will impart a cyclical, circular motion to the transport unit 4.

A holding means (not shown) is arranged adjacent to each station S. Each holding means may be arranged for simultaneous handling of a plurality of containers 2. In the embodiment shown, containers 2 are moved in groups of three from one station S to the next.

As stated above, the transport unit 4 is arranged to move the containers 2 in the transverse direction P2 along a curved path 6 and comprises to this end one transfer means 18 for each station S.

In the embodiment shown, each transfer means 18 is arranged to handle containers 2 in groups of three and comprises four jaws 19, which are each carried by a beam.

The jaws 19 engage a top portion of the three aligned containers 2 at each station S.

More specifically, a first one 19*a* of the jaws engages an upper front portion 20 of the front one 2*a* of the three containers. A second one 19*b* of the jaws engages an upper rear portion 21 of the front container 2*a* and an upper front portion 20 of the middle one 2*b* of the three containers. A third one 19*b* of the jaws engages an upper rear portion 21 of the middle container 2*b* and an upper front portion 20 of the rear one 2*c* of the three containers. Finally, a fourth one 19 of the jaws engages an upper rear portion 21 of the rear container 2*c*.

By driving the electric motor 16, a circular motion will be imparted to the transport unit 4, as described above. Thus, each transfer means 18 will be cyclically moved along an endless, circular path.

More specifically, each transfer means 18 will be cyclically moved along a path extending between a pick-up position and a delivery position located adjacent to the station associated therewith. In FIG. 3, the pick-up position is indicated at A and the delivery position at B for one of the transfer means 18.

In the embodiment shown, each transfer means 18 is arranged to pick up three containers 3 in the pick-up position A and to deliver the containers, in the delivery position B, to the transfer means 18 provided for the station S.

The holding means and the transfer means 18 are operable between an open and a closed position.

More specifically, each holding means is arranged to assume its open position in response to the associated transfer means 18, during its movement along the endless path, passing the pick-up position A. Correspondingly, the holding means is arranged to assume its closed position when the associated transfer means 18 passes the delivery position B.

Furthermore, each transfer means 18 is arranged to assume, during its movement along the endless path, its closed position when passing the pick-up position A and its open position when passing the delivery position B.

To open and close a holding means or a transfer means, its jaw is opened and closed, respectively. A jaw may have the form of a pair of fingers and the operation of the jaw may be achieved by means of a pneumatic unit, which opens and closes, respectively, the pair of fingers of the jaw.

As described above, the stations S are arranged after each other, as seen in said transverse direction P2. Moreover, according to the embodiment each station S has a holding means which is stationary arranged in connection therewith. The transfer means 18 associated with each station S is movable between a pick-up position A and a delivery position B, the delivery position B being located adjacent to the station S concerned. The pick-up position A is arranged such that it corresponds to the delivery position B of a transfer means 18 associated with the closest station S upstream thereof. As a result, a container 2 which has been applied to a first station S will be picked up, after the processing at said first station S has been completed, by the transfer means 18 associated with a second station S located downstream thereof for further transport to said second station S.

In FIGS. 4*a-i*, to which reference is now made, the functioning of an embodiment of the inventive device 3 is schematically illustrated.

The device 3 comprises three stations, S1, S2, S3, a transport unit 4 and holding means (not shown), which are arranged adjacent to the respective stations S1, S2, S3. In addition, a holding means (not shown) is arranged at a feeding position 22 and a discharge position 23, respectively. The transport unit 4 carries for each station S1, S2, S3 a transfer means 18*a*, 18*b*, 18*c* provided therefor. There is also provided a transfer means 18*d* associated with the discharge position 23. Furthermore, the transport unit 4 is carried by rotatable mounts 8. Each mount 8 comprises an arm 14, which at its end facing away from the centre of rotation C of the mount 8 is pivotally carried in bearings in the transport unit 4. This allows a circular motion to be imparted to the transport unit 4 and, more specifically, each of the transfer means 18*a-c* to be cyclically moved along a circular, endless path between a pick-up position A and delivery position B. The pick-up position A of each of the transfer means is evident from FIG. 4*a* and the delivery position B is evident from FIG. 4*e*.

In the embodiment shown the device comprises three stations: an opening station S1, a filling station S2 and a sealing station S3. It will be appreciated that the device 3 may comprise other stations as well as more or fewer stations.

The opening station S1 mainly comprises a pair of suction cups 24, which are adapted to engage opposite side wall portions of a container 2. These side wall portions define a filling duct. By actuating and moving apart the suction cups 24, said side wall portions can be separated for opening of the filling duct of the container 2. As described above, the container 2 has already been opened in a preceding step by removing an end seal thereof. Thus, to open the filling duct said side wall portions of the already opened container are separated, whereby the filling duct forms a tubular connection between the compartment of the container 2 and the surroundings.

The filling station S2 comprises a filling tube 25, which upon insertion in the opened filling duct of the container 2 is arranged to conduct a liquid product to the compartment of the container 2.

The sealing station S3 comprises a pair of sealing jaws 26, which are adapted to engage the side wall portions of the container 2 for sealing said filling duct. Sealing may be achieved, for instance, by means of heat welding or ultrasonic welding.

In the embodiment shown, each station S1, S2, S3 is arranged to handle one container 2. It will be appreciated, however, that the stations S1, S2, S3 may be arranged for parallel handling of more than one container 2. In this case, the transport unit 4 may be arranged for parallel transport of a corresponding number of containers 2 from one station to the next.

Figure 4A:
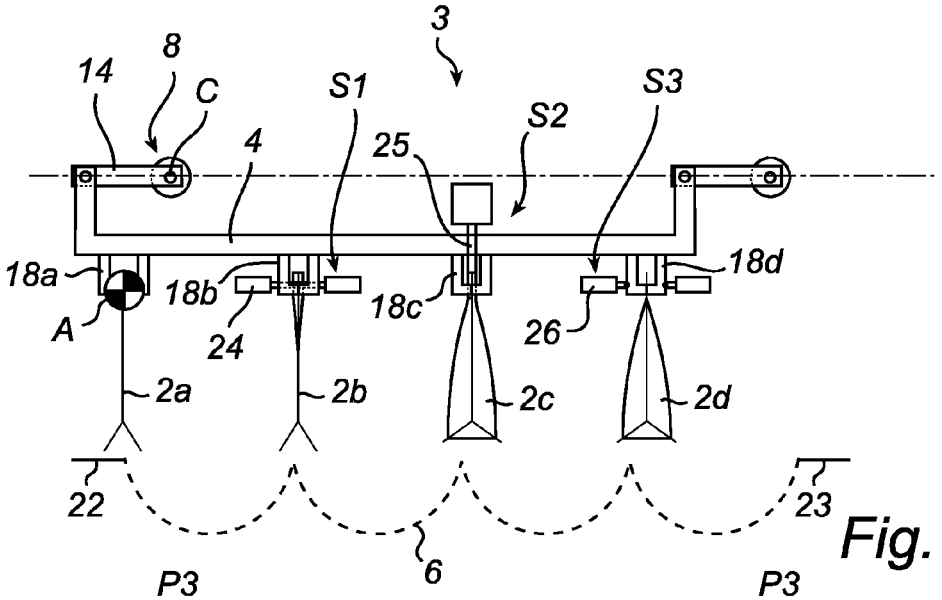
FIGS. 4*a-i* are schematic side views of an inventive device as it assumes different operational positions.
Figure 4B:
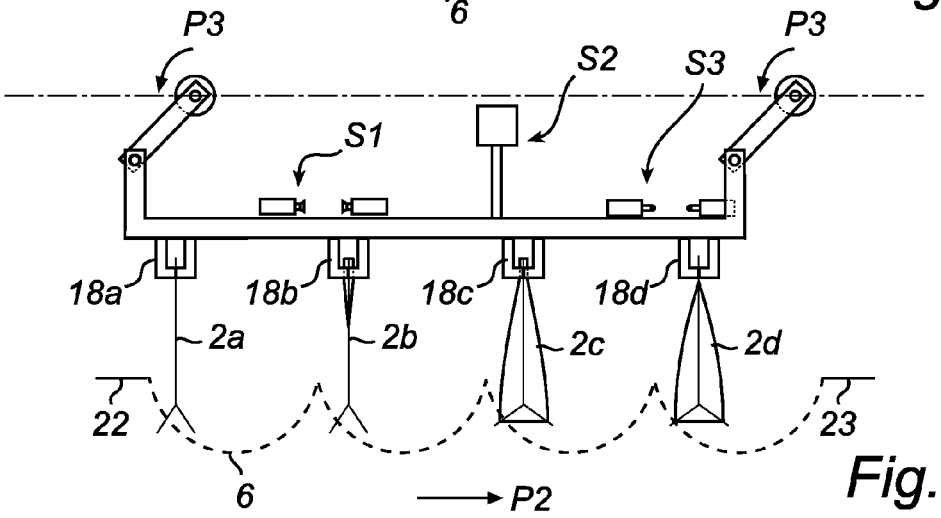
Figure 4C:
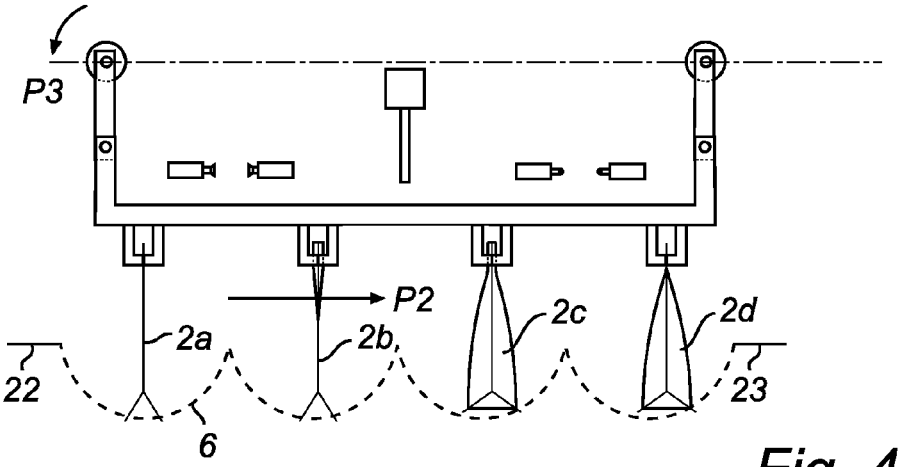
Figure 4D:
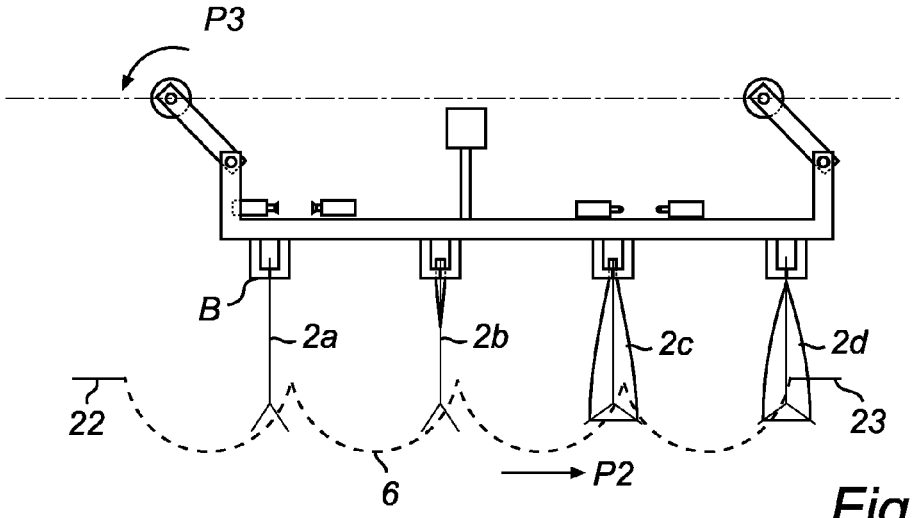
Figure 4E:
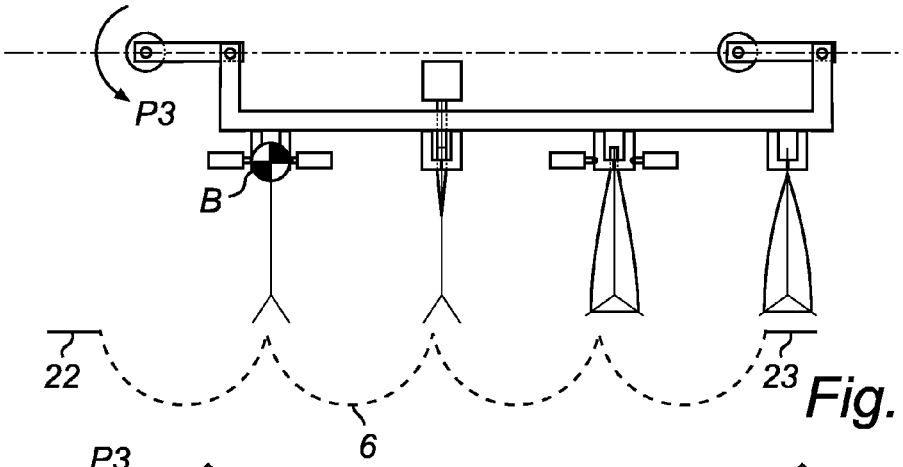

FIG. 4*a* shows the transport unit 4 in a position such that its transfer means 18*a-d* are in their pick-up positions A.

In addition, the transfer means 18*a-d* have been actuated so as to assume their closed state, in which they each grip the upper portion of a container 2.

A first one 2*a* of the containers is situated in a feeding position 22 of the device and is oriented in a first direction P1, which means that the upper side of the container 2*a* is arranged parallel to said first direction P1.

A second one 2*b* of the containers is located at the opening station S1, the suction cups 24 of the opening station S1 having been actuated to separate the side wall portions of the container 2*b*.

A third one 2*c* of the containers is located at the filling station S2, a liquid product having been supplied to the container 2*c* through the filling tube 25 of the filling station S2.

A fourth one 2*d* of the containers is located at the sealing station S3, the sealing jaws 26 of the sealing station S3 having been actuated to seal the filling duct of the filled container 2*d*.

FIGS. 4*b-e* show how the mounts 8 are pivoted in the direction of rotation indicated by the arrow P1. This will impart a circular motion to the transport unit 4 and, thus, to said transfer means 18*a-d*, which results in the transfer means 18*a-d* being moved from their respective pick-up position A to their delivery position B. In this way, each container 2*a-d* is transported from the previous station to the next station by being moved in a second direction P2 along a curved path 6, said second direction P2 being a transverse direction for the containers 2*a-d* and, thus, perpendicular to said first direction P1.

In the delivery positions B, the containers 2*a-d* are transferred to the holding means of the respective station S1, S2, S3. Accordingly, as is clearly illustrated in FIG. 3*e*, the first container 2*a* is applied to the opening station S1, the second container 2*b* to the filling station S2, the third container 2*c* to the sealing station S3 and the fourth container 2*d* to the discharge position 23.

In connection with the transfer of the containers 2*a-d*, the stationary holding means are moved to their closed positions and the transfer means 18*a-d* carried by the transport unit 4 to their open positions.

FIGS. 4*f-i* show how the mounts 8 continue their pivoting motion in said direction of rotation P1. This pivoting will cause the transport unit 4 to continue its circular motion, whereby the transfer means 18*a-d* will be moved from their respective delivery position B to the pick-up position A along the circular path.

Figure 4F:
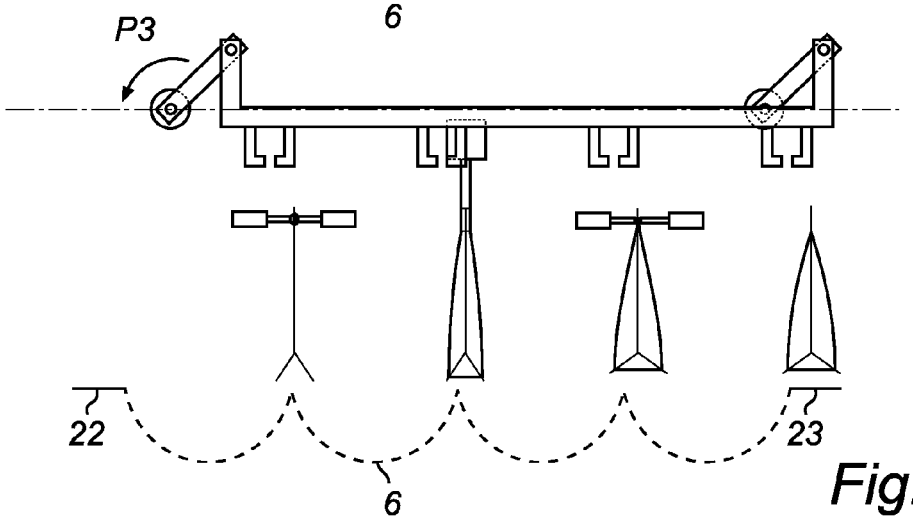
Figure 4G:
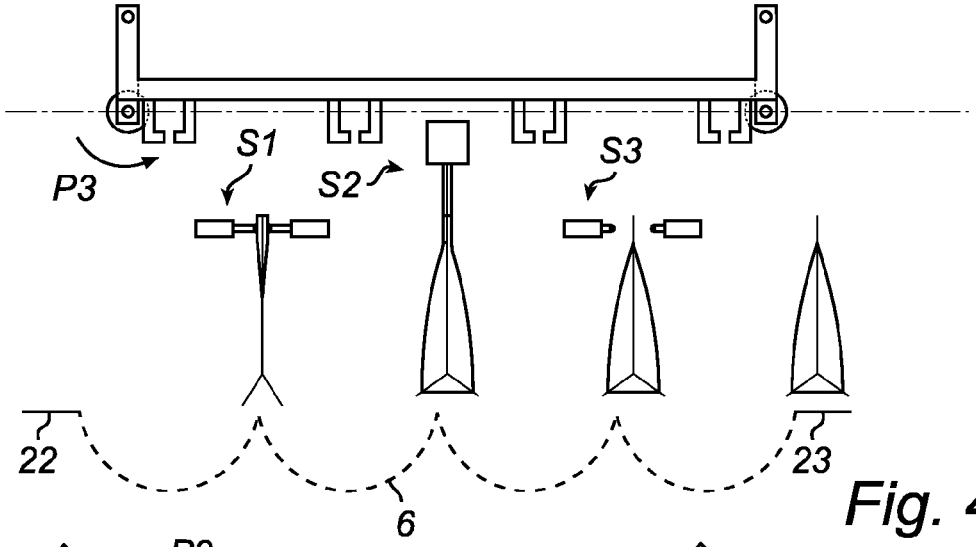
Figure 4H:
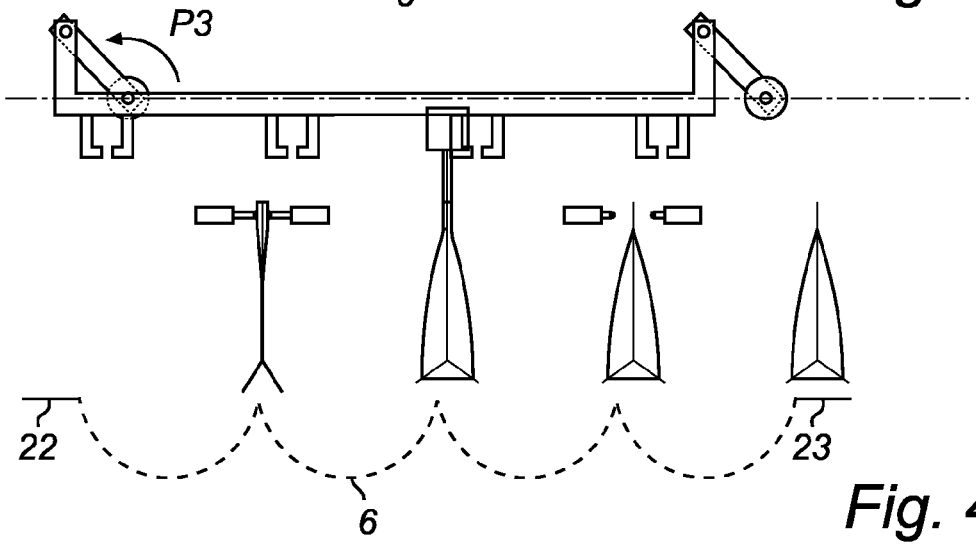

In addition, FIG. 4*f* shows how the opening station S1 has been actuated to bring the suction cups 24 into engagement with the side wall portions of the first container 2*a*. Furthermore, the filling station S2 has been actuated to transfer a liquid product to the second container 2*b* via the filling tube 25. Finally, the sealing jaws 26 of the sealing station S3 have been brought into engagement with the third container 2*c* for sealing of the filling duct. FIG. 4*h* illustrates that the opening of the first container 2*a*, the filling of the second container 2*b* and the sealing of the third container 2*c* have been completed.

Figure 4I:
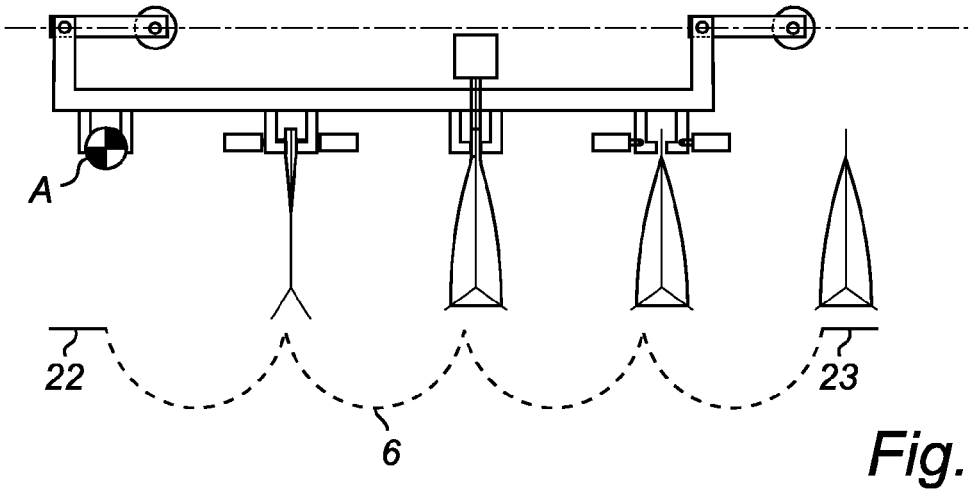

In FIG. 4*i* the transfer means 18*a-d* have been moved to their respective pick-up position A. In the feeding position 22 a new container 2*e* is indicated by dashed lines. By moving the transfer means 18*a-d* to their closed positions in which they each grip a respective container 2*e*, 2*a-c* and, at the same time, opening the holding means (not shown), the cycle can be repeated so as to transfer a container from one station to the next one.

Figure 5:
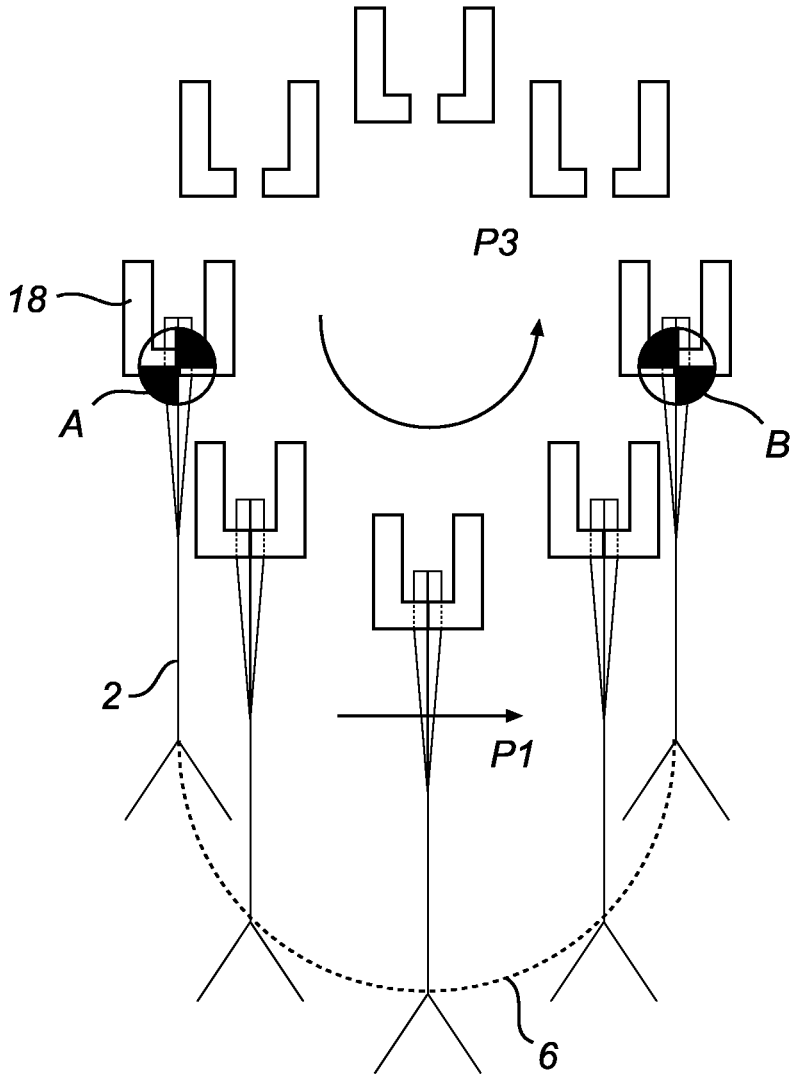
FIG. 5 is a side view of a transfer means of a transport unit in different positions corresponding to the operational positions shown in FIGS. 4*a-i*.

In FIG. 5, to which reference is now made, a transfer means 18 is separately illustrated as it is being subjected to a cyclical circular motion between a pick-up position A and a delivery position B. As shown in the figure, the transfer means 18, when moved, in its closed state, from the pick-up position A to the delivery position B, acts to transport a container 2 in said transverse direction P1 along a curved path 6. The transfer means 18 is then returned by being moved, in its open state, from the delivery position B to the pick-up position A.

Thus, the transport unit 4 of the inventive device 3 is arranged to transport a container 2 to a station S by moving it in a transverse direction P2 along a curved path 6.

The extension in the transverse direction of the containers 2 is significantly smaller than their longitudinal extension, i.e. in said first direction P1. This is true, in particular, before the containers 2 have been filled with a content, i.e. when the containers 2 are in a flat condition, with substantially no extent in said transverse direction P2. Because the containers 2, when being transported between the stations S, are moved laterally—i.e. in the direction in which the containers 2 have the smallest extent—the shortest distance that each container 2 must be moved to transfer it from one station S to the next is reduced. As a result, the time required to move one container 2 from one station S to another is minimized, which of course has a favourable effect on the speed at which the device 3 is capable of handling containers 2.

Because the containers 2, when transported from one stations S to another, are moved along a curved path 6, it is possible to ensure that the containers 2, when arriving at a delivery position B, i.e. when arriving at a station S, have a component of movement that is transverse to said first P1 and said second P2 direction, i.e. directed vertically upwards in the embodiments shown. More specifically, this is achieved by each transfer means being cyclically moved along a circular path in the direction of rotation indicated by the arrow P3 between a pick-up position A located in a position corresponding to nine o'clock and a delivery position B located in a position corresponding to three o'clock. Because the container 2, when arriving at the delivery position B, has a movement directed vertically upwards, it is possible to have it dock with the station S concerned. Accordingly, each station S may be stationary in the vertical direction. Neither the opening station S1, the filling station S2 nor the sealing station S3 need to be movable in the vertical direction to be brought into contact with the respective container 2, since it is the containers 2 that are moved to the stations S1, S2, S3. This means that the stations can be of a comparatively simple design.

It will be appreciated that the present invention is not limited to that described above.

The inventive device may, for example, comprise more, fewer or other stations.

Such other stations may be a gas-filling station comprising a gas means for supplying a gas to a handle portion of the container. The handle portion may be formed in the connecting portion of the container on a side opposite to the pouring spout of the container. The gas means may be arranged to supply said gas through a hole formed in one of the side walls of the containers and communicating with the handle portion via a gas duct, which too is formed in the connecting portion of the container. The gas duct may have a cross-sectional area that is significantly smaller than the cross-sectional area of the handle portion.

An additional station may be a sealing station comprising a sealing means for sealing the above-mentioned gas duct for enclosing a gas supplied to the handle portion. The sealing means may be arranged to provide a seal across the extent of the gas duct by means of heat welding or ultrasonic welding.

Several modifications and variations are conceivable, and therefore the scope of the present invention is defined solely by the appended claims.

The invention claimed is:

1. A device for handling a container of a collapsible type, comprising:

at least one station, and a transfer device provided for said at least one station and carried by a transport unit and said transfer device is cyclically moveable along an endless path between a pick-up position and a delivery position located adjacent to the station, said device being arranged to receive said container in an upright position and oriented in a first horizontal direction, and said transfer device being arranged to transport said container to said at least one said station by moving the container, the container being in a fixed orientation relative to said first horizontal direction, in a second horizontal direction along said endless path, said second horizontal direction being perpendicular to said first horizontal direction, a holding device provided for said at least one station and located in a stationary position adjacent to the station, the transfer device being arranged to pick up the container in the pick-up position and transfer the container, in the delivery position, to the holding device.

2. A device according to claim 1, wherein the container comprises a compartment which is defined by two opposite side walls and a bottom wall, said side walls being joined at a top portion thereof for forming an upper side extending along a line and wherein the orientation of the container in said first horizontal direction is made so that the upper side of the container is arranged substantially parallel to said first horizontal direction.

3. A device according to claim 1, wherein said transfer device is arranged to engage a top portion of said container during transport thereof.

4. A device according to claim 1, wherein the holding device is operable between a closed position for gripping the container and an open position for releasing the container, the holding device being, arranged to assume the closed position and the open position in response to the transfer device, during its travel along an endless path, passing the delivery position and the pick-up position, respectively.

5. A device according to claim 1, wherein the transfer device is operable between an open position for releasing the container and a closed position for gripping the container, the transfer device, during its travel along the endless path, being arranged to assume the closed position and the open position when passing the pick-up position and the delivery position, respectively.

6. A device according to claim 1, further comprising a pneumatic unit controlling the holding device and the transfer device.

7. A device according to claim 1, wherein the transfer device, when passing the delivery position, having a component of movement that is perpendicular to said second horizontal direction.

8. A device according to claim 1, in which the endless path along which the transfer device is movable has the shape of a circle, the pick-up position being arranged in a position corresponding to nine o'clock and the delivery position being arranged in a position corresponding to three o'clock.

9. A device according to claim 1, wherein one of said stations is a filling station having a filling tube, which through a relative motion is insertable in a filling duct in the container.

10. A device according to claim 9, wherein the filling tube of the filling station is arranged in a stationary manner.

11. A device according to claim 1, wherein said at least one station is an opening station having an opener which is arranged to separate side wall portions of the container for the purpose of opening a filling duct.

12. A device according to claim 1, wherein said at least one station is a sealing station having a sealer arranged to seal a filling duct in the container.

13. A device according to claim 1, wherein said at least one station is a gas-filling station, which comprises a gas supply supplying a gas to a handle portion of the container, the gas supply being arranged to supply said gas through a hole formed in one of the side walls of the container and communicating with the handle portion via a gas duct.

14. A device according to claim 1, wherein said at least one station is a sealing station, which comprises a sealer sealing a gas duct for enclosing a gas supplied to a handle portion of the container.

15. A device according to claim 1, wherein the transport unit is arranged to transport said container to a plurality of stations by moving it in the second horizontal direction along endless paths, said plurality of stations being arranged one after the other in said second horizontal direction.

16. A device according to claim 1, wherein said at least one station is arranged for simultaneous handling of a plurality of containers.

17. A device according to claim 1, wherein the transport unit is carried by a rotary mount at a radial distance from a centre of rotation of the mount.

18. A method for handling containers of a collapsible type in a filling machine, said containers being in an upright position and each having a compartment defined by two opposite side walls and a bottom wall, the method comprising:

orienting the containers in a first horizontal direction, so that upper sides of the containers are substantially parallel to said first horizontal direction, and transporting the containers, the containers being in a fixed orientation relative to said first horizontal direction, to at least one station by moving them in a second horizontal direction along an endless path, said second horizontal direction being perpendicular to said first horizontal direction, the moving of said containers is achieved with the aid of a transfer devise, which is provided for said at least one station and which is cyclically moved along said endless path between a pick-up position and a delivery position located adjacent to the station, the transfer device picking up at least one container in the pick-up position and delivering said at least one container in the delivery position.

19. A method according to claim 18, in which said at least one station comprises a filling station for filling the containers.

* * * * *